US012352111B2

(12) United States Patent
Schaffer

(10) Patent No.: US 12,352,111 B2
(45) Date of Patent: Jul. 8, 2025

(54) DRILLING JIG ASSEMBLY

(71) Applicant: Robert Schaffer, Huron, SD (US)

(72) Inventor: Robert Schaffer, Huron, SD (US)

( * ) Notice: Subject to any disclaimer, the term of this patent is extended or adjusted under 35 U.S.C. 154(b) by 504 days.

(21) Appl. No.: 17/968,357

(22) Filed: Oct. 18, 2022

(65) Prior Publication Data

US 2024/0123519 A1 Apr. 18, 2024

(51) Int. Cl.
*E21B 7/02* (2006.01)
*E02D 27/42* (2006.01)
*E21B 15/00* (2006.01)

(52) U.S. Cl.
CPC ..... *E21B 15/00* (2013.01)

(58) Field of Classification Search
CPC ..... E21B 7/02–7/028; E02D 27/42; E02D 27/00; E02D 27/32; E02D 5/34; E02D 5/36; E02D 5/38
See application file for complete search history.

(56) References Cited

U.S. PATENT DOCUMENTS 3,219,308 A * 11/1965 Halstead ..... E02D 27/00 249/48
3,858,866 A * 1/1975 Armstrong ..... E02D 27/42 249/83
4,357,755 A 11/1982 Allen
8,056,299 B2 * 11/2011 Liskey ..... E04C 3/34 52/125.2
8,347,514 B1 1/2013 McCollum
10,501,949 B2 * 12/2019 Weaver ..... E04G 13/021
10,914,046 B1 * 2/2021 Nasir ..... E02D 5/46
2007/0175136 A1 * 8/2007 Knepp ..... E04G 13/02 52/294
2011/0061321 A1 * 3/2011 Phuly ..... F03D 13/22 52/297
2013/0207305 A1 * 8/2013 Moore ..... E04H 12/22 264/262

FOREIGN PATENT DOCUMENTS

CN 102433935 5/2012
JP 2019112811 7/2019

* cited by examiner

*Primary Examiner* — Kipp C Wallace

(57) ABSTRACT

A drilling jig assembly includes a hub unit that has a receiver and a plurality of spokes and the receiver engages a kelly bar of a drilling rig. A plurality of bolt jigs is each coupled to a respective one of the spokes on the hub unit to receiving a respective one of a plurality of bolts of a bolt cage. A plurality of yoke supports is each slidably disposed on a respective one of the spokes of the hub unit such that each of the yoke supports is spaceable an adjustable distance from the receiver of the hub unit. Each of the yoke supports can be attached to a concrete form surrounding the bolt cage thereby facilitating the concrete form to be maneuvered by the drilling rig when the receiver of the hub unit is attached to the drilling rig.

12 Claims, 7 Drawing Sheets

DRILLING JIG ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to jig devices and more particularly pertains to a new jig device for attaching a concrete form and a bolt cage to a drilling rig. The device includes a hub unit that is attachable to a kelly bar of a drilling rig and plurality of spokes radiating outwardly from the hub unit which each has a telescopically adjustable length. The device includes a plurality of bolt jigs that are each attached to a respective spoke for engaging a bolt cage. The device includes a plurality of yoke supports that is each slidably attached to a respective spoke for attaching to a concrete form thereby facilitating the concrete form and the bolt cage to be maneuvered with the drilling rig.

(2) Description of Related Art Including Information Disclosed Under 37 CFR 1.97 and 1.98

The prior art relates to jig devices including a work suspension device that includes a plurality of rods that can be assembled to define a support frame for suspending a rebar cage in a vertical shaft. The prior art discloses a column pad layout device that comprises a pair of intersecting cross-arms, a third arm attached to the intersecting cross-arms and a bolt layout attached to the intersecting cross arms. The prior art discloses an alignment jig that includes a plurality of alignment cross members which form a rectangle for locating footings.

BRIEF SUMMARY OF THE INVENTION

An embodiment of the disclosure meets the needs presented above by generally comprising a hub unit that has a receiver and a plurality of spokes and the receiver engages a kelly bar of a drilling rig. A plurality of bolt jigs is each coupled to a respective one of the spokes on the hub unit to receiving a respective one of a plurality of bolts of a bolt cage. A plurality of yoke supports is each slidably disposed on a respective one of the spokes of the hub unit such that each of the yoke supports is spaceable an adjustable distance from the receiver of the hub unit. Each of the yoke supports can be attached to a concrete form surrounding the bolt cage thereby facilitating the concrete form to be maneuvered by the drilling rig when the receiver of the hub unit is attached to the drilling rig.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
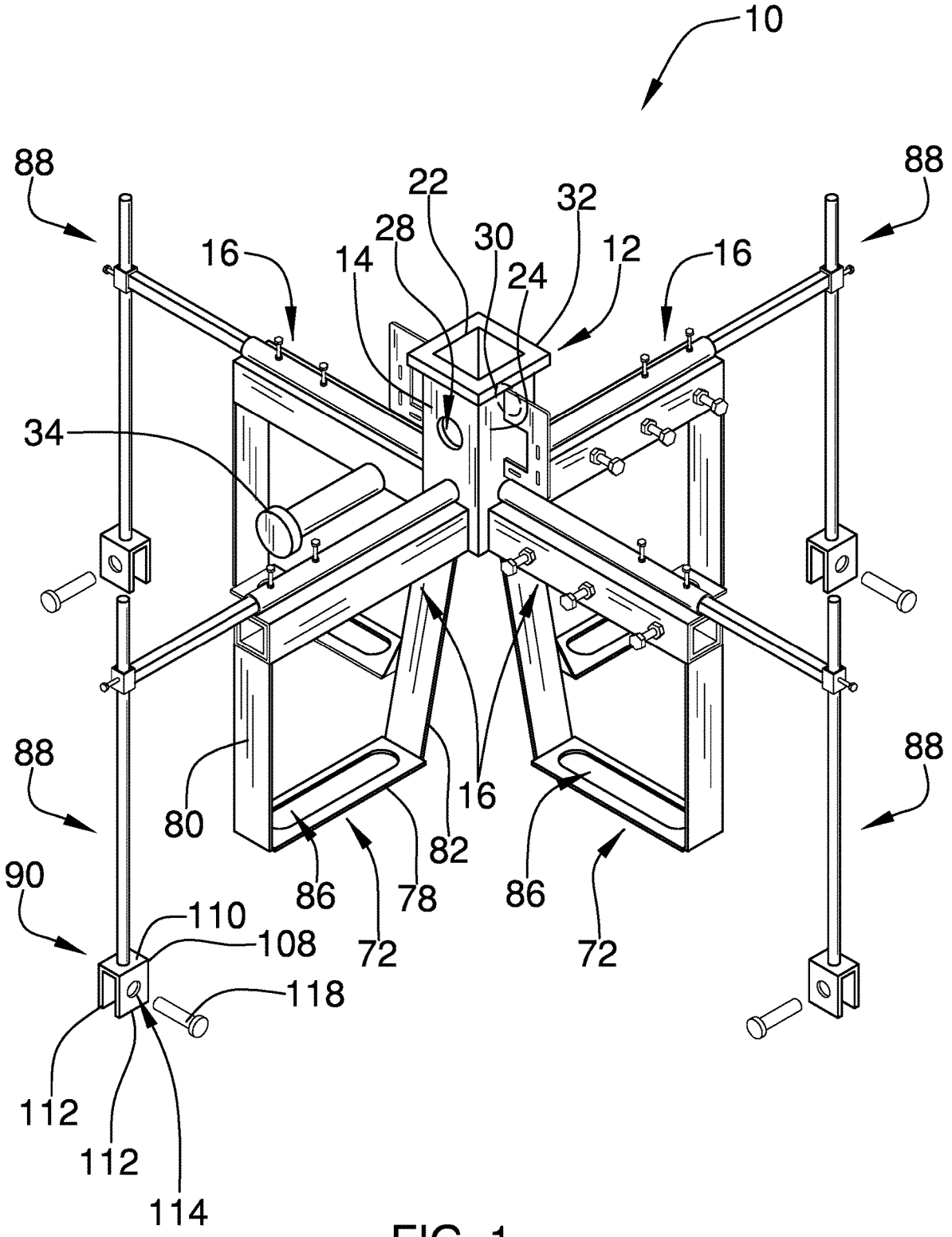
FIG. 1 is a top perspective view of a drilling jig assembly according to an embodiment of the disclosure.
Figure 2:
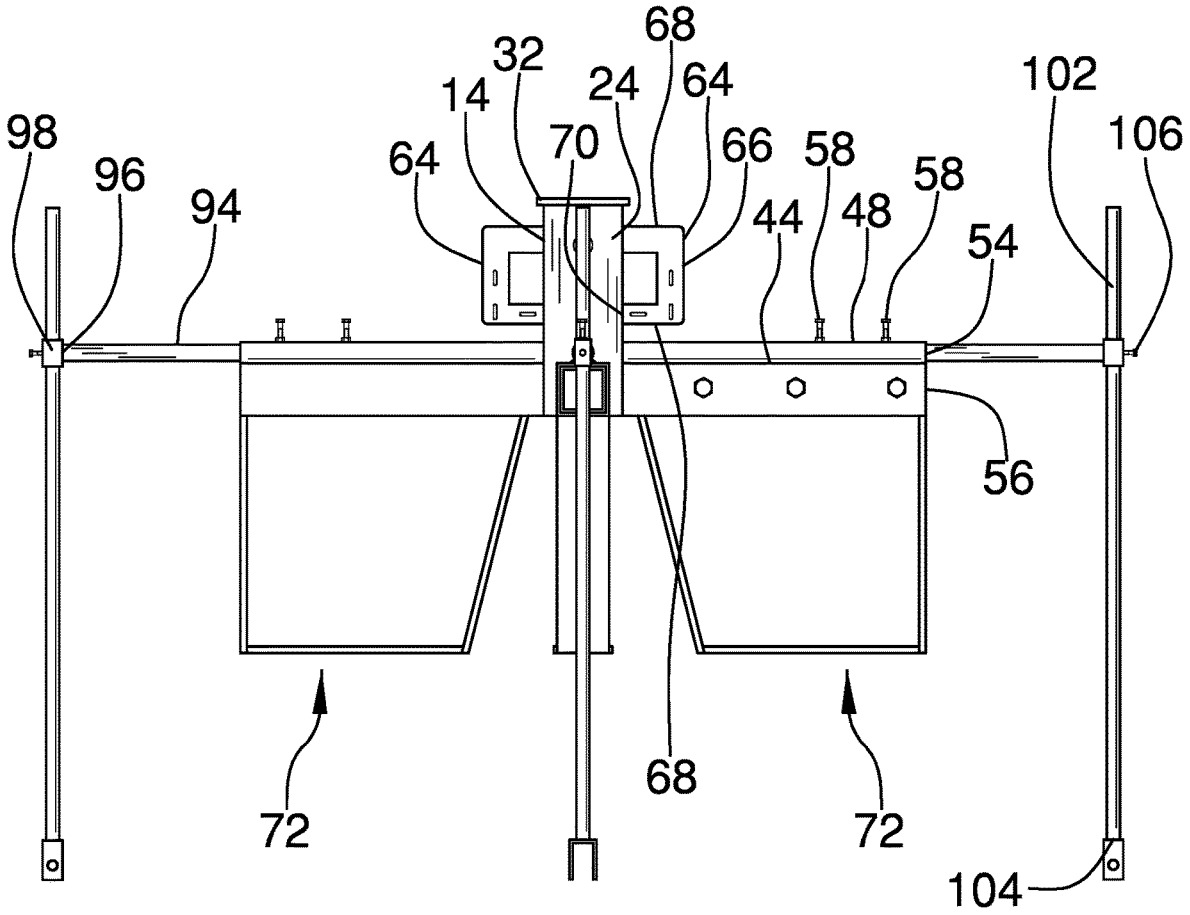
FIG. 2 is a front view of an embodiment of the disclosure.
Figure 3:
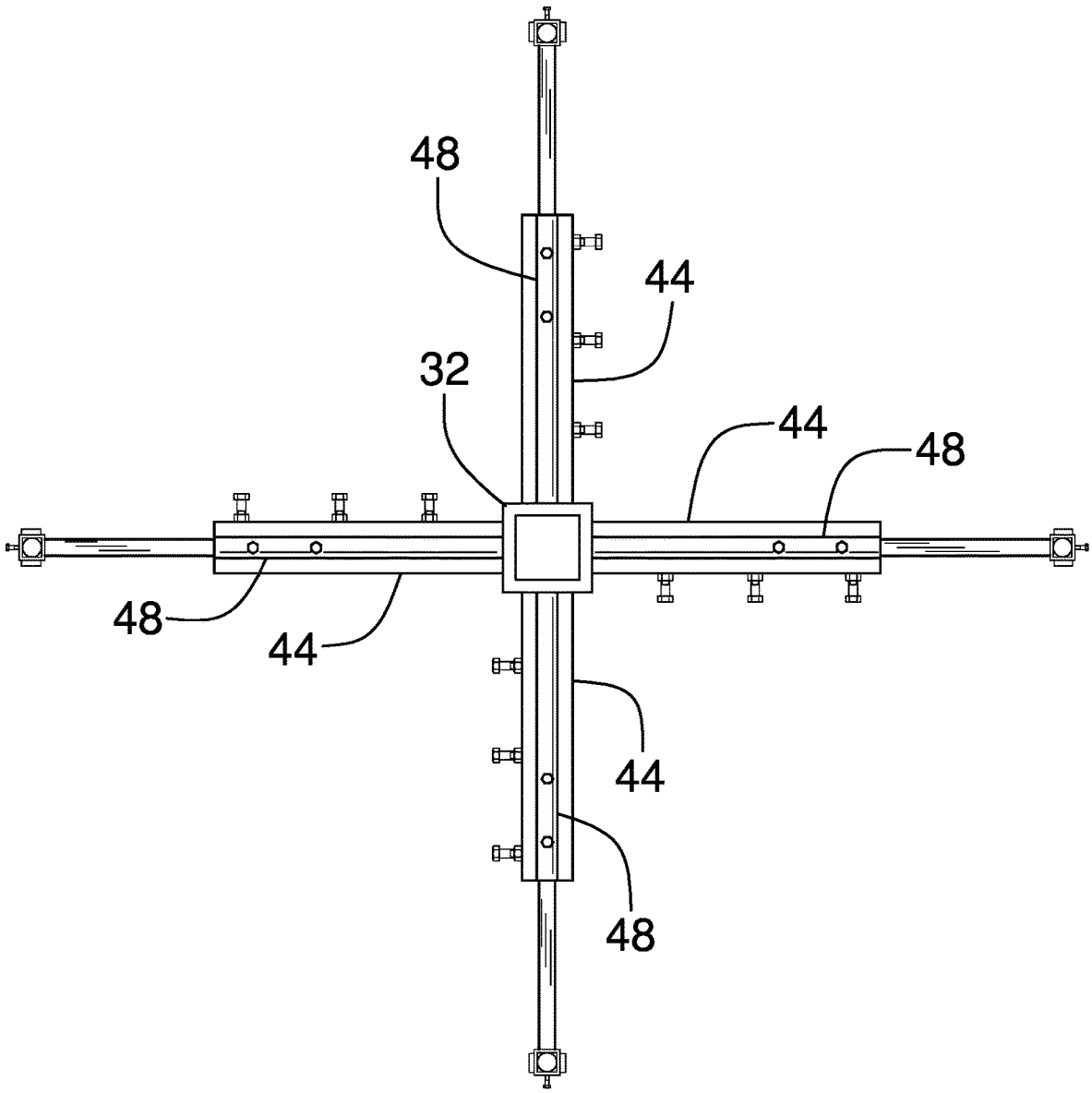
FIG. 3 is a top view of an embodiment of the disclosure.
Figure 4:
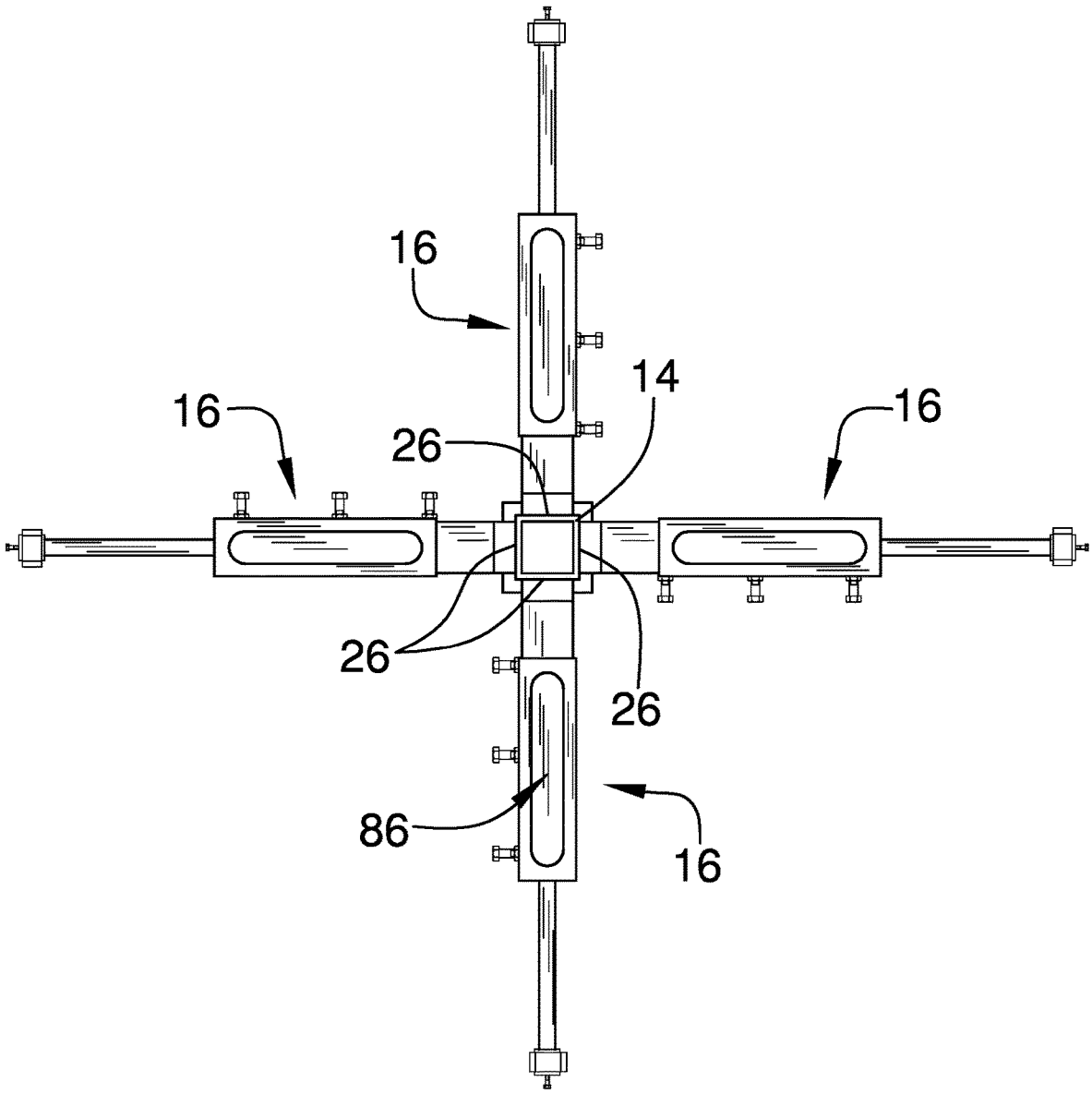
FIG. 4 is a bottom view of an embodiment of the disclosure.
Figure 5:
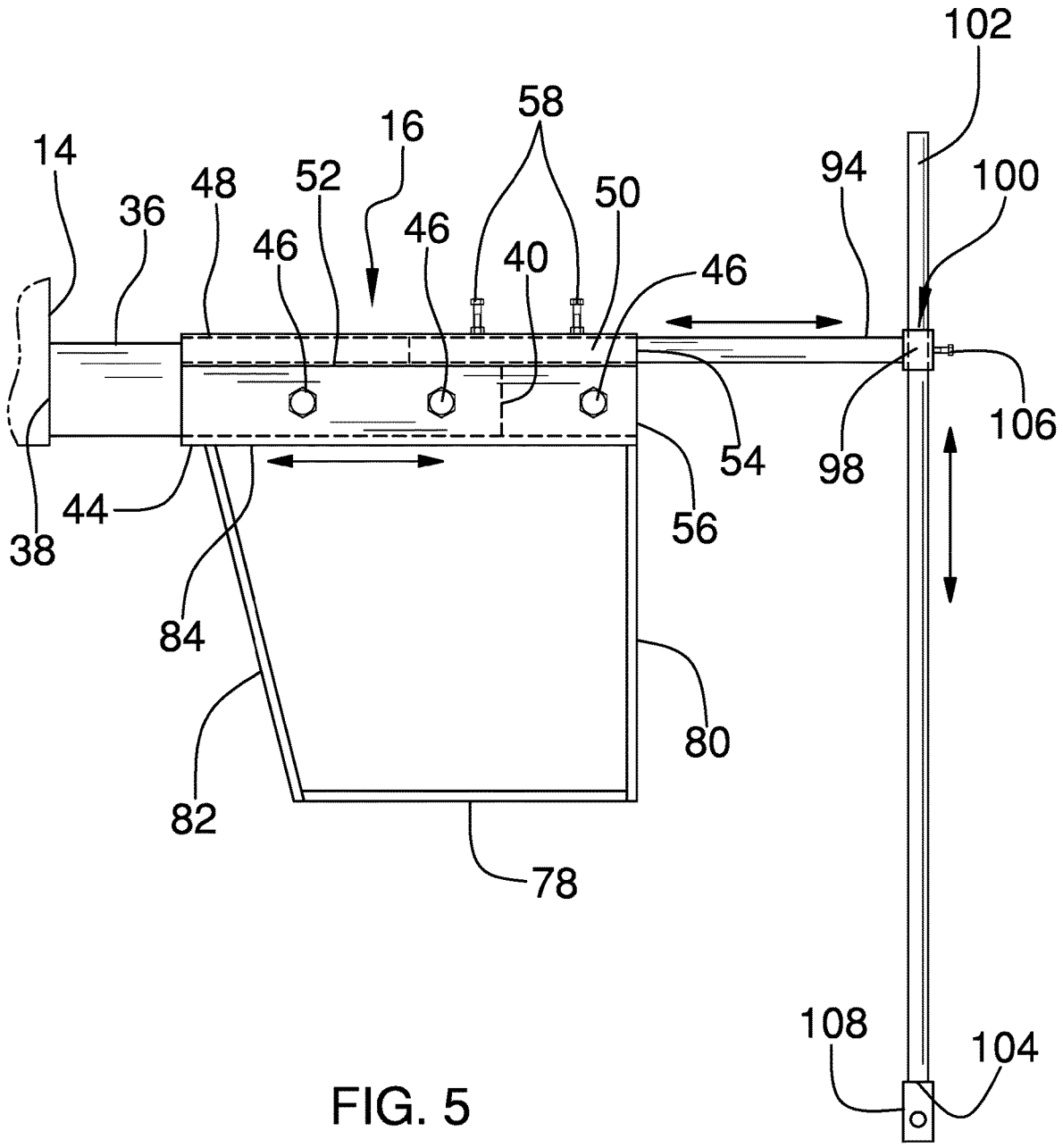
FIG. 5 is a front view of a bolt jig and a spoke of an embodiment of the disclosure.
Figure 6:
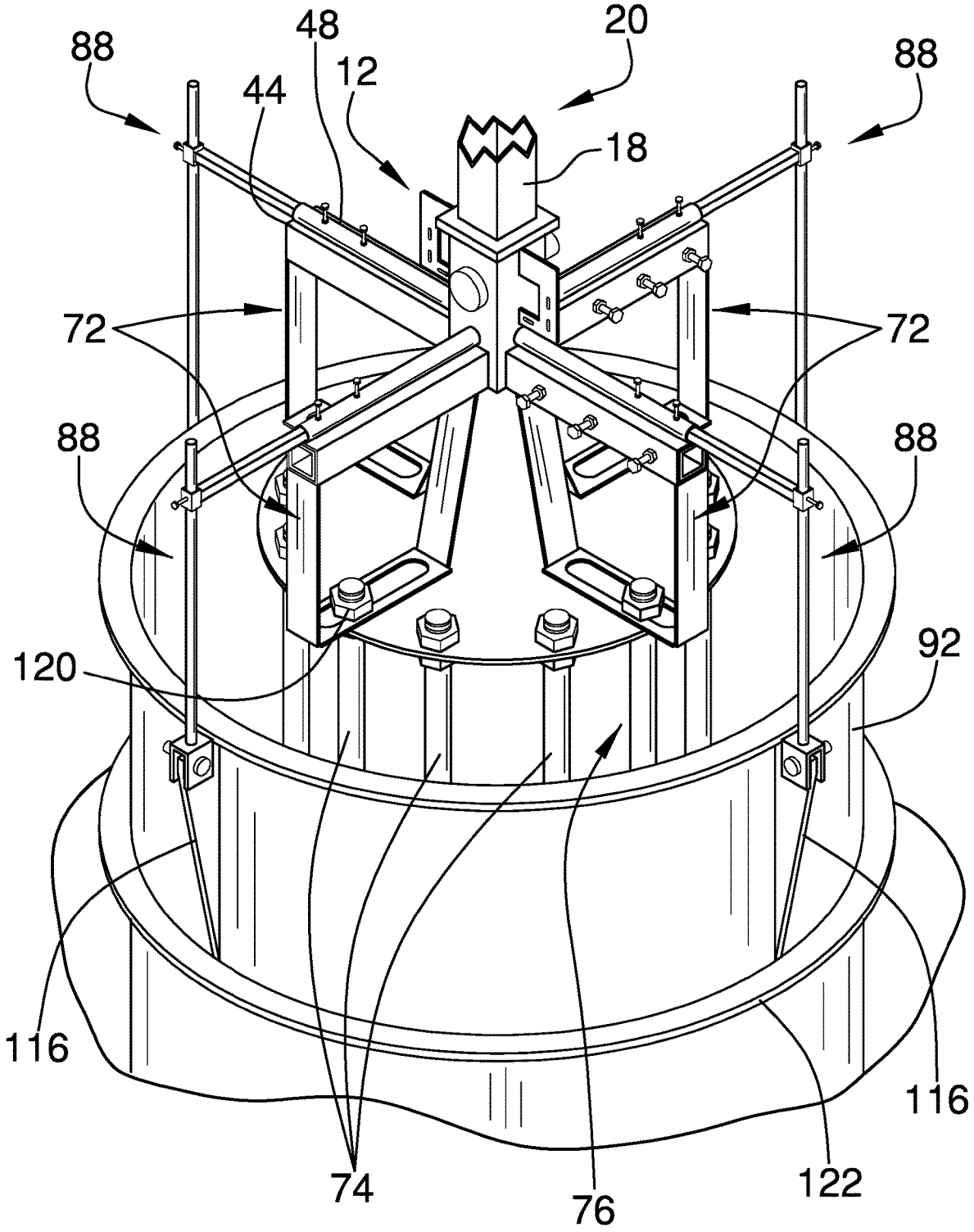
FIG. 6 is a perspective in-use view of an embodiment of the disclosure prior to concrete being poured into a piling.
Figure 7:
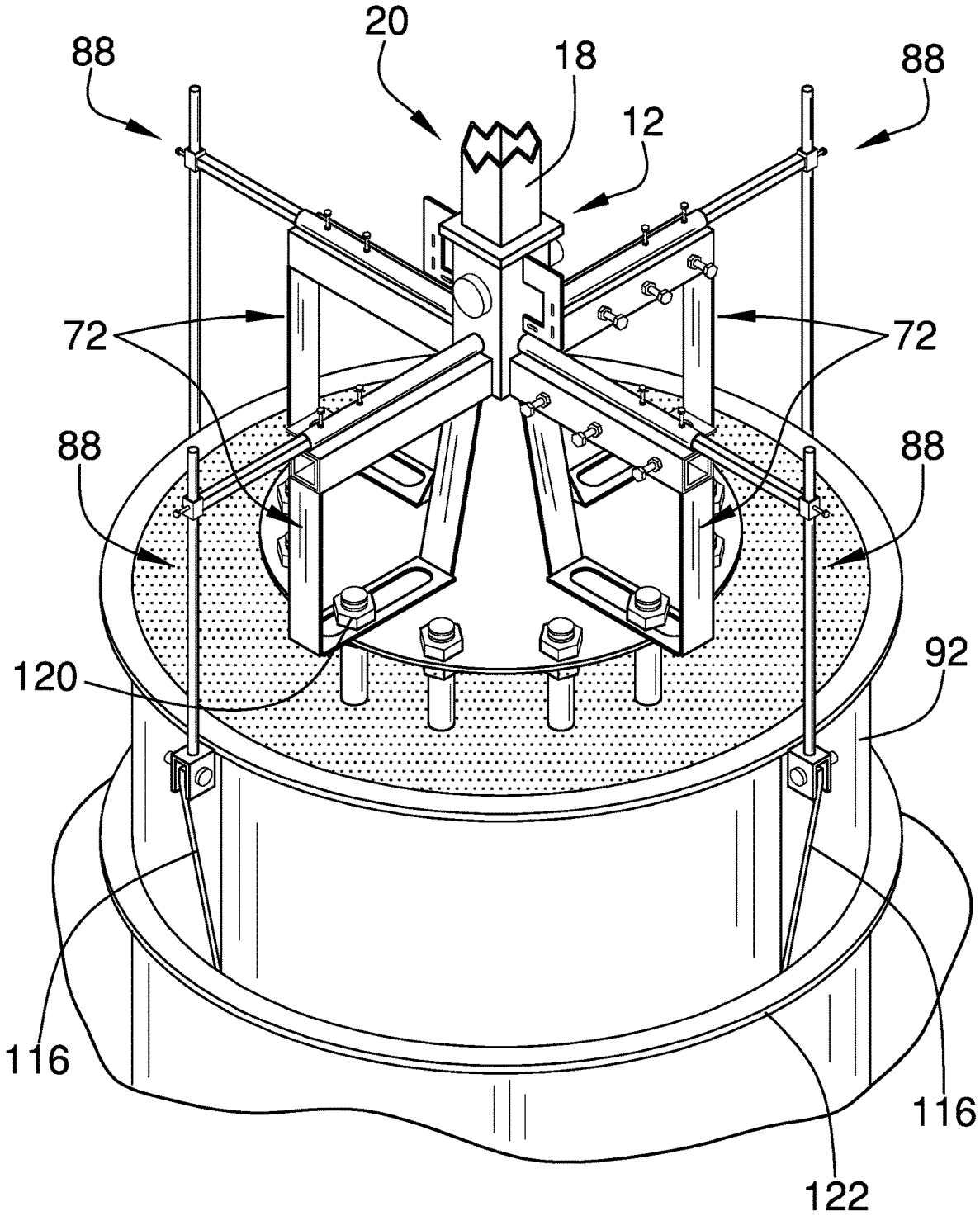
FIG. 7 is perspective in-use view of an embodiment of the disclosure after concrete has been poured into a piling.

With reference now to the drawings, and in particular to FIGS. 1 through 7 thereof, a new jig device embodying the principles and concepts of an embodiment of the disclosure and generally designated by the reference numeral 10 will be described.

As best illustrated in FIGS. 1 through 7, the drilling jig assembly 10 generally comprises a hub unit 12 that has a receiver 14 and a plurality of spokes 16 each radiating from the receiver 14. The receiver 14 engages a kelly bar 18 of a drilling rig 20 thereby facilitating the hub unit 12 to be positioned with the drilling rig 20. The drilling rig 20 may be mobile drilling rig of any conventional design commonly employed in oil field drilling and other types of subterranean drilling. Additionally, each of the spokes 16 has a telescopically adjustable length.

The receiver 14 has an upper end 22 that is open and an outer wall 24 extending downwardly from the upper end 22. The outer wall 24 has a plurality of intersecting sides 26 such that the receiver 14 has a rectilinear shape thereby facilitating the receiver 14 to conform to the shape of the kelly bar 18 of the drilling rig 20. The outer wall 24 has a first hole 28 and a second hole 30 each extending through a respective one of the intersecting sides 26 and the first hole 28 is aligned with the second hole 30.

Furthermore, each of the spokes 16 is positioned on a respective one of the intersecting sides 26 of the outer wall 24 of the receiver 14. The receiver 14 may have a length ranging between approximately 25.0 cm and 35.0 cm and width ranging between approximately 15.0 cm and 20.0 cm. A box 32 may be integrated around the outer wall 24 of the receiver 14 and the box 32 may be aligned with the upper end 22 of the receiver 14 for reinforcing the outer wall 24. A first pin 34 is insertable through each of the first hole 28 and the second hole 30 in the outer wall 24 of the receiver 14 such that the first pin 34 extends through the kelly bar 18 of the drilling rig 20 for retaining the receiver 14 on the kelly bar 18.

Each of the spokes 16 comprises a member 36 that has a coupled end 38 which is coupled to a respective one of the intersecting sides 26 of the outer wall 24 of the receiver 14. The member 36 has a free end 40 that is open and the member 36 is positioned adjacent to a bottom end 42 of the receiver 14. Each of the spokes 16 includes a first tube 44 that is slidably positioned around the member 36 such that the first tube 44 is slidable toward or away from the receiver 14. Continuing, each of the spokes 16 includes a plurality of first fasteners 46 that each extends through an outer wall 47 of the first tube 44. Each of the first fasteners 46 engages the member 36 when the first fasteners 46 are tightened to retain the first tube 44 at a selected distance from the receiver 14. The plurality of first fasteners 46 is spaced apart from each other and is distributed along a substantial length of the first tube 44. The member 36 may have a length ranging between approximately 45.0 cm and 55.0 cm and a height and width ranging between approximately 10.0 cm and 13.0 cm. Furthermore, the first tube 44 may have a length ranging between approximately 45.0 cm and 55.0 cm such that each of the spokes 16 has a length that can be adjusted between approximately 45.0 cm and 90.0 cm.

Each of the spokes 16 includes a second tube 48 that has an outer wall 50 which is bonded to a top side 52 of the outer wall 47 of the first tube 44. The second tube 48 is oriented collinear with the first tube 44 and the second tube 48 has a leading end 54 that is aligned with a forward end 56 of the first tube 44. Each of the spokes 16 includes a plurality of second fasteners 58 that each extends through the outer wall 60 of the second tube 48. The plurality of second fasteners 58 is spaced apart from each other and is distributed along the second tube 48. Additionally, each of the second fasteners 58 may comprise a bolt or other type of threaded fastener.

A pair of handles 64 is each attached to the receiver 14 of the hub unit 12 thereby facilitating each of the handles 64 to be gripped for positioning the receiver 14 on the kelly bar 18 of the drilling rig 20. Each of the handles 64 has a middle section 66 extending between a pair of outward sections 68. A distal end 70 of each of the outward sections 68 is attached to a respective one of the intersecting sides 26 of the outer wall 24 of the receiver 14 thereby facilitating the middle section 66 of each of the handles 64 to be gripped.

A plurality of bolt jigs 72 is provided and each of the bolt jigs 72 is coupled to a respective one of the spokes 16 on the hub unit 12. Each of the bolt jigs 72 receives a respective one of a plurality of bolts 74 of a bolt cage 76 thereby facilitating the bolt cage 76 to be maneuvered by the drilling rig 20 when the receiver 14 of the hub unit 12 is attached to the drilling rig 20. The bolt cage 76 may be a bolt cage employed for establishing a connection point 116 on a concrete piling or other type of vertical poured concrete structure. Each of the bolt jigs 72 comprises a central member 78 extending between a front member 80 and a rear member 82. The front member 80 is perpendicularly oriented with the central member 78 and the rear member 82 is oriented at an angle with the central member 78 such that the rear member 82 angles away from the front member 80. The central member 78, the front member 80 and the rear member 82 of each of the bolt jigs 72 may have a length ranging between approximately 45.0 cm and 50.0 cm.

Each of the front member 80 and the rear member 82 is attached to and extends downwardly from a bottom side 84 of the outer wall 24 of the first tube 44 of the respective spoke such that the central member 78 lies on a plane that is oriented parallel with the bottom side 84 of the outer wall 24. The front member 80 is aligned with the forward end 56 of the first tube 44 of the respective spoke 16. The central member 78 has a slot 86 extending through the central member 78 thereby facilitating the slot 86 to insertably receive a respective one of the bolts 74 of the bolt cage 76. Additionally, the slot 86 is elongated to extend along a substantial length of the central member 78 thereby facilitating the respective bolt 74 of the bolt cage 76 to be positioned at a variety of locations along the slot 86 such that the bolt jigs 72 can accommodate varying sizes of bolt cages.

A plurality of yoke supports 88 is provided and each of the yoke supports 88 is slidably disposed on a respective one of the spokes 16 of the hub unit 12 such that each of the yoke supports 88 is spaceable an adjustable distance from the receiver 14 of the hub unit 12. Each of the yoke supports 88 has a coupling 90 that is directed downwardly with respect to the hub unit 12 thereby facilitating each of the yoke supports 88 to be attached to a concrete form 92 surrounding the bolt cage 76. In this way the concrete form 92 and the bolt cage 76 can be maneuvered by the drilling rig 20 when the receiver 14 of the hub unit 12 is attached to the drilling rig 20. Furthermore, the concrete form 92 may be a ring form commonly employed in the construction of concrete piers and other types of poured circular concrete structures.

Each of the yoke supports 88 comprises a first rod 94 that is slidably positioned in the second tube 48 associated with a respective one of the spokes 16. The first rod 94 has a distal end 96 with respect to the second tube 48 and the distal end 96 of the first rod 94 is spaceable an adjustable distance from the leading end 54 of the second tube 48. Each of the second fasteners 62 in the second tube 48 engages the first rod 94 when the second fasteners 62 are tightened for retaining the first rod 94 at a selected position. A collar 98 is coupled to the leading end 54 of the second tube 48 such that an opening 100 defined by the collar 98 extends along an axis that is perpendicularly oriented with the first rod 94. The first rod 94 may have a length ranging between approximately 60.0 cm and 75.0 cm.

Each of the yoke supports 88 includes a second rod 102 that is slidably positioned in the collar 98 such that the second rod 102 is perpendicularly oriented with the first rod 94. The second rod 102 has a lower end 104 that is spaceable a selected distance from the collar 98. Additionally, each of the yoke supports 88 includes a set screw 106 which extends through the collar 98 and engages the second rod 102 when the set screw 106 is tightened for retaining the second rod 102 at a selected position in the collar 98. The second rod 102 may have a length ranging between approximately 120.0 cm and 150.0 cm.

Each of the yoke supports 88 includes a yoke 108 that has an upper member 110 and a pair of sidelong members 112 each extending away from the upper member 110. The upper member 110 is attached to the lower end 104 of the second rod 102 such that each of the sidelong members 112 extends downwardly from the second rod 102. Each of the sidelong members 112 has an opening 114 extending through the sidelong members 112 and each of the sidelong members 112 is positioned to straddle a connection point 116 on the concrete form 92. Each of the yoke supports 88 includes a second pin 118 that is extendable through the opening 114 in each of the sidelong members 112 such that the second pin 118 extends through the connection point 116 on the concrete form 92 for attaching the yoke 108 to the connection point 116.

In use, the receiver 14 is attached to the kelly bar 18 of the drilling rig 20 and each of the spokes 16 is adjusted to a length to facilitate each of the bolts 74 to extend through the slot 86 in the central member 78 associated with a respective bolt jig 72. Each bolt 74 is fastened to the central member 78 with a nut 120 threaded on the bolt 74. The first rod 94 associated with each of the yoke supports 88 is adjusted to an appropriate length to align the second rod 102 associated with each of the yoke supports 88 with a respective connection point 116 on the concrete form 92. Continuing, each of the second rods 102 is adjusted to an appropriate length to facilitate the yoke 108 associated with each yoke 108 support to straddle the respective connection point 116 and the second pin 118 is inserted through the yoke 108 to attach the yoke 108 to the respective connection point 116. In this way the bolt cage 76 and the concrete form 92 can be manipulated as a single unit with the drilling rig 20 for positioning the bolt cage 76 and the concrete form 92 in a piling 122 prior to pouring concrete into the piling 122. In this way the bolt cage 76 and the concrete form 92 can be quickly and precisely positioned in the piling 122. The nut 120 on each bolt 74 is removed and the yoke 108 associated with each of the yoke supports 88 is uncoupled from the concrete form 92 when the concrete poured into the piling 122 has cured to facilitate the hub unit 12, the bolt jigs 72 and the yoke supports 88 to be lifted from the concrete form 92 and the bolt cage 76.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A drilling jig assembly for attaching a concrete form and bolt cage to a drilling rig, said assembly comprising:

a hub unit having a receiver and a plurality of spokes each radiating from said receiver, said receiver engaging a kelly bar of a drilling rig thereby facilitating said hub unit to be positioned with the drilling rig, each of said spokes having a telescopically adjustable length;

a pair of handles, each of said handles being attached to said receiver of said hub unit thereby facilitating each of said handles to be gripped for positioning said receiver on the kelly bar of the drilling unit;

a plurality of bolt jigs, each of said bolt jigs being coupled to a respective one of said spokes on said hub unit, each of said bolt jigs receiving a respective one of a plurality of bolts of the bolt cage thereby facilitating the bolt cage to be maneuvered by the drilling rig when said receiver of said hub unit is attached to the drilling rig; and a plurality of yoke supports, each of said yoke supports being slidably disposed on a respective one of said spokes of said hub unit such that each of said yoke supports is spaceable an adjustable distance from said receiver of said hub unit, each of said yoke supports having a coupling being directed downwardly with respect to said hub unit thereby facilitating each of said yoke supports to be attached to the concrete form surrounding the bolt cage thereby facilitating the concrete form to be maneuvered by the drilling rig when said receiver of said hub unit is attached to the drilling rig.

2. The assembly according to claim 1, wherein said receiver has an upper end being open and an outer wall extending downwardly from said upper end, said outer wall having a plurality of intersecting sides such that said receiver has a rectilinear shape thereby facilitating said receiver to conform to the shape of the kelly bar of the drilling rig, said outer wall having a first hole and a second hole each extending through a respective one of said intersecting sides, said first hole being aligned with said second hole, each of said spokes being positioned on a respective one of said intersecting sides of said outer wall of said receiver.

3. The assembly according to claim 2, wherein each of said spokes comprises:

a member having a coupled end being coupled to a respective one of said intersecting sides of said outer wall of said receiver, said member having a free end being open, said member being positioned adjacent to a bottom end of said receiver;

a first tube being slidably positioned around said member such that said first tube is slidable toward or away from said receiver; and a plurality of first fasteners, each of said first fasteners extending through an outer wall of said first tube, each of said first fasteners engaging said member when said first fasteners are tightened for retaining said first tube at a selected distance from said receiver, said plurality of first fasteners being spaced apart from each other and being distributed along a substantial length of said first tube.

4. The assembly according to claim 3, wherein each of said spokes includes:

a second tube having an outer wall being bonded to a top side of said outer wall of said first tube, said second tube being oriented collinear with said first tube, said second tube having a leading end being aligned with a forward end of said first tube; and a plurality of second fasteners, each of said second fasteners extending through said outer wall of said second tube, said plurality of second fasteners being spaced apart from each other and being distributed along said second tube.

5. The assembly according to claim 2, further comprising a first pin being insertable through each of said first hole and said second hole in said outer wall of said receiver such that said first pin extends through the kelly bar of the drilling rig for retaining said receiver on the connection shaft.

6. The assembly according to claim 2, wherein each of said handles has a middle section extending between a pair of outward sections, a distal end of each of said outward sections being attached to a respective one of said intersecting sides of said outer wall of said receiver thereby facilitating said middle section of each of said handles to be gripped.

7. The assembly according to claim 3, wherein each of said bolt jigs comprises a central member extending between a front member and a rear member, said front member being perpendicularly oriented with said central member, said rear member being oriented at an angle with said central member such that said rear member angles away from said front member, each of said front member and said rear member being attached to and extending downwardly from a bottom side of said outer wall of said first tube of said respective spoke such that said central member lies on a plane being oriented parallel with said bottom side of said outer wall, said front member being aligned with said forward end of said first tube of said respective spoke.

8. The assembly according to claim 7, wherein said central member has a slot extending through said central member thereby facilitating said slot to insertably receive a respective one of the bolts of the bolt cage, said slot being elongated to extend along a substantial length of said central member thereby facilitating the respective bolt of the bolt cage to be positioned at a variety of locations along said slot such that said bolt jigs can accommodate varying sizes of bolt cages.

9. The assembly according to claim 4, wherein each of said yoke supports comprises:

a first rod being slidably positioned in said second tube associated with a respective one of said spokes, said first rod having a distal end with respect to said second tube, said distal end being spaceable an adjustable distance from said leading end of said second tube, each of said second fasteners in said second tube engaging said first rod when said second fasteners are tightened for retaining said first rod at a selected position; and a collar being coupled to said distal end of said second tube such that an opening defined by said collar extends along an axis being perpendicularly oriented with said first rod.

10. The assembly according to claim 9, wherein each of said yoke supports includes:

a second rod being slidably positioned in said collar such that said second rod is perpendicularly oriented with said first rod, said second rod having a lower end being spaceable a selected distance from said collar; and a set screw extending through said collar and engaging said second rod when said set screw is tightened for retaining said second rod at a selected position in said collar.

11. The assembly according to claim 10, wherein each of said yoke supports includes:

a yoke having an upper member and a pair of sidelong members each extending away from said upper member, said upper member being attached to said lower end of said second rod such that each of said sidelong members extends downwardly from said second rod, each of said sidelong members having an opening extending through said sidelong members, each of said sidelong members straddling a connection point on the concrete form; and a second pin being extendable through said opening in each of said sidelong members such that said second pin extends through the connection point on the concrete form for attaching said yoke to the connection point.

12. A drilling jig assembly for attaching a concrete form and bolt cage to a drilling rig, said assembly comprising:

a hub unit having a receiver and a plurality of spokes each radiating from said receiver, said receiver engaging a kelly bar of a drilling rig thereby facilitating said hub unit to be positioned with the drilling rig, each of said spokes having a telescopically adjustable length, said receiver having an upper end being open and an outer wall extending downwardly from said upper end, said outer wall having a plurality of intersecting sides such that said receiver has a rectilinear shape thereby facilitating said receiver to conform to the shape of the kelly bar of the drilling rig, said outer wall having a first hole and a second hole each extending through a respective one of said intersecting sides, said first hole being aligned with said second hole, each of said spokes being positioned on a respective one of said intersecting sides of said outer wall of said receiver, each of said spokes comprising:

a member having a coupled end being coupled to a respective one of said intersecting sides of said outer wall of said receiver, said member having a free end being open, said member being positioned adjacent to a bottom end of said receiver;

a first tube being slidably positioned around said member such that said first tube is slidable toward or away from said receiver;

a plurality of first fasteners, each of said first fasteners extending through an outer wall of said first tube, each of said first fasteners engaging said member when said first fasteners are tightened for retaining said first tube at a selected distance from said receiver, said plurality of first fasteners being spaced apart from each other and being distributed along a substantial length of said first tube;

a second tube having an outer wall being bonded to a top side of said outer wall of said first tube, said second tube being oriented collinear with said first tube, said second tube having a leading end being aligned with a forward end of said first tube; and a plurality of second fasteners, each of said second fasteners extending through said outer wall of said second tube, said plurality of second fasteners being spaced apart from each other and being distributed along said second tube;

a first pin being insertable through each of said first hole and said second hole in said outer wall of said receiver such that said first pin extends through the kelly bar of the drilling rig for retaining said receiver on the connection shaft;

a pair of handles, each of said handles being attached to said receiver of said hub unit thereby facilitating each of said handles to be gripped for positioning said receiver on the kelly bar of the drilling unit, each of said handles having a middle section extending between a pair of outward sections, a distal end of each of said outward sections being attached to a respective one of said intersecting sides of said outer wall of said receiver thereby facilitating said middle section of each of said handles to be gripped;

a plurality of bolt jigs, each of said bolt jigs being coupled to a respective one of said spokes on said hub unit, each of said bolt jigs receiving a respective one of a plurality of bolts of the bolt cage thereby facilitating the bolt cage to be maneuvered by the drilling rig when said receiver of said hub unit is attached to the drilling rig, each of said bolt jigs comprising a central member extending between a front member and a rear member, said front member being perpendicularly oriented with said central member, said rear member being oriented at an angle with said central member such that said rear member angles away from said front member, each of said front member and said rear member being attached to and extending downwardly from a bottom side of said outer wall of said first tube of said respective spoke such that said central member lies on a plane being oriented parallel with said bottom side of said outer wall, said front member being aligned with said forward end of said first tube of said respective spoke, said central member having a slot extending through said central member thereby facilitating said slot to insertably receive a respective one of the bolts of the bolt cage, said slot being elongated to extend along a substantial length of said central member thereby facilitating the respective bolt of the bolt cage to be positioned at a variety of locations along said slot such that said bolt jigs can accommodate varying sizes of bolt cages; and a plurality of yoke supports, each of said yoke supports being slidably disposed on a respective one of said spokes of said hub unit such that each of said yoke supports is spaceable an adjustable distance from said receiver of said hub unit, each of said yoke supports having a coupling being directed downwardly with respect to said hub unit thereby facilitating each of said yoke supports to be attached to the concrete form surrounding the bolt cage thereby facilitating the concrete form to be maneuvered by the drilling rig when said receiver of said hub unit is attached to the drilling rig, each of said yoke supports comprising:

a first rod being slidably positioned in said second tube associated with a respective one of said spokes, said first rod having a distal end with respect to said second tube, said distal end being spaceable an adjustable distance from said leading end of said second tube, each of said second fasteners in said second tube engaging said first rod when said second fasteners are tightened for retaining said first rod at a selected position;

a collar being coupled to said leading end of said second tube such that an opening defined by said collar extends along an axis being perpendicularly oriented with said first rod;

a second rod being slidably positioned in said collar such that said second rod is perpendicularly oriented with said first rod, said second rod having a lower end being spaceable a selected distance from said collar;

a set screw extending through said collar and engaging said second rod when said set screw is tightened for retaining said second rod at a selected position in said collar;

a yoke having an upper member and a pair of sidelong members each extending away from said upper member, said upper member being attached to said lower end of said second rod such that each of said sidelong members extends downwardly from said second rod, each of said sidelong members having an opening extending through said sidelong members, each of said sidelong members straddling a connection point on the concrete form; and a second pin being extendable through said opening in each of said sidelong members such that said second pin extends through the connection point on the concrete form for attaching said yoke to the connection point.

* * * * *